US005472249A

United States Patent [19]

Fiedler

[11] Patent Number: 5,472,249

[45] Date of Patent: Dec. 5, 1995

[54] EXCAVATOR GRAPPLE SCOOP ATTACHMENT

[76] Inventor: Paul H. Fiedler, P.O. Box 6496, Bridgewater, N.J. 08807

[21] Appl. No.: 185,261

[22] Filed: Jan. 24, 1994

[51] Int. Cl.[6] ..... B66C 3/00; E02F 3/60

[52] U.S. Cl. ..... 294/2; 294/68.23; 37/405; 414/724

[58] Field of Search ..... 294/2, 3, 50.8, 294/51, 59, 68.23, 107; 37/403, 405, 406, 407, 409, 410, 450, 452, 454, 455; 179/719, 772, 772 S; 414/723, 724

[56] References Cited

U.S. PATENT DOCUMENTS

| | | | |
|---|---|---|---|
| 421,364 | 2/1890 | Vaag | 294/51 |
| 969,307 | 9/1910 | Sumerlin | 294/51 |
| 2,382,955 | 8/1945 | Billings . | |
| 2,577,977 | 12/1951 | Nelson | 37/405 X |
| 3,157,288 | 11/1964 | Wieger . | |
| 3,426,460 | 2/1969 | Hinkel et al. . | |
| 3,523,380 | 8/1970 | Bolyard et al. . | |
| 3,942,271 | 3/1976 | George | 294/51 X |
| 4,009,529 | 3/1977 | Johnson | 172/719 X |
| 4,360,980 | 11/1982 | Jarvis | 414/724 X |
| 4,392,774 | 7/1983 | Thomas, Jr. . | |
| 4,550,512 | 12/1985 | Felstet . | |
| 4,907,356 | 3/1990 | LaBounty . | |
| 4,991,386 | 2/1991 | Dirksen | 294/50.8 X |
| 5,024,397 | 6/1991 | Edwards et al. | 294/68.23 |
| 5,253,449 | 10/1993 | Webb et al. | 37/450 X |

*Primary Examiner*—Dean Kramer
*Attorney, Agent, or Firm*—Kenneth P. Glynn

[57] ABSTRACT

The present invention is directed at a device attachable to a grapple having tined jaws for scooping debris. The device comprises a first and second plate each having a front, a back, a rear edge, a leading edge, and two side edges. The device further comprising a first and second fastener for securing the first and second plate to the grapple jaws. Each fastener comprises a chock mounted to the back of each plate. The chock is adapted to fit snugly between the tines of the grapple jaw.

11 Claims, 5 Drawing Sheets

EXCAVATOR GRAPPLE SCOOP ATTACHMENT

BACKGROUND OF THE INVENTION

1. Field of the Invention

The present invention relates generally to a grapple attachment, and more specifically to a grapple attachment which is capable of handling fine debris and which easily fastens to the tines of an existing grapple jaw.

2. Information Disclosure Statement

Grapples are typically utilized in demolition work and for clearing debris from the site. Various grapple configurations are possible. For example, a common grapple consists of two tined jaws—one jaw more or less stationary, and the other jaw movable and operated by means such as hydraulics or cables. Although that device can effectively grasp large pieces of debris, smaller debris often falls through the tines.

To alleviate this problem, smooth edged devices have been developed to facilitate better containment of finer debris. For example, Felstet, U.S. Pat. Nos. 4,550,512, Thomas, Jr. 4,392,774, Wieger, U.S. Pat. No. 3,157,288, R. O. Billings U.S. Pat. No. 2,382,955, Labounty U.S. Pat. No. 4,907,356, W. D. Hinkel et al. U.S. Pat. Nos. 3,426,460, and Bolyard et al. 3,523,380 each use blades or flat edges to handle debris. Of these devices, however, only the last three are designed to be attached to the tines of an existing grapple jaw.

Although Labounty, Hinkel, and Bolyard are designed for mounting on the tines of an existing bucket or grapple, they nevertheless suffer from other shortcomings. For example, Labounty discloses a device which contains sockets for receiving the tines of a grapple. Although the sockets certainly secure the device, such sockets add complexity, cost, and weight to the device. Furthermore, the Labounty device discloses only a single bucket arrangement. This allows debris to fall between the tines of the other jaw.

Like Labounty, Hinkel also uses a design which encases the tines of the jaw. This increases cost and weight. Hinkel also discloses a complex means of attaching the device to a clam shell bucket. That is, a chain and lever assembly serve to hold the device in intimate contact with the bucket. Again, this adds complexity, cost, and weight to the device. The chain also increases the risk that the device may become entangled with debris.

The Bolyard device uses a simple mechanism to fasten to the tines, however, the tines are mounted in front of the plate. This allows debris to lodge between the tines and the plate. Moreover, this arrangement restricts the shape of the plate to a planar surface, without sides or curvature.

Therefore, the prior art fails to provide a grapple attachment which is capable of handling fine debris, and which easily attaches to the tines of a grapple jaw. The present invention fulfills this need.

SUMMARY OF THE INVENTION

The present invention is directed at a device which attaches to the jaws of a grapple. An object of this invention is to provide a device which enables the user to handle fine debris. The device accomplishes this through plates having leading edges which are either smooth or have meshing tines. When the grapple closes, the edges meet to prevent debris from falling through.

Another object of this invention is to provide an easy means of attaching the device to the tines of the grapple jaw. The invention accomplishes this by mounting chocks on the back of the device which brace it between the tines of the grapple jaw. This avoids the expense and extra weight of using sockets to receive the tines.

Thus, the invention offers an improvement over the prior art in both the shape of the grapple attachment and the means in which the device attaches to the grapple jaw.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, the several figures in which like reference numerals identify like elements and in which:

DETAILED DESCRIPTION OF THE PRESENT INVENTION

The present invention is directed at improving both the shape of a grapple attachment and the means in which the device attaches to the grapple jaws. Typically, a grapple contains two jaws—one remaining substantially stationary to provide a backstop, and the other moving in a way to scoop debris. Although the particular embodiment described herein relates to a grapple, it should be understood that the present invention could be used for a variety of applications. For example, it could be attached to large bucket excavators, bulldozers, or any type of earth moving or debris removing machinery.

Figure 1:
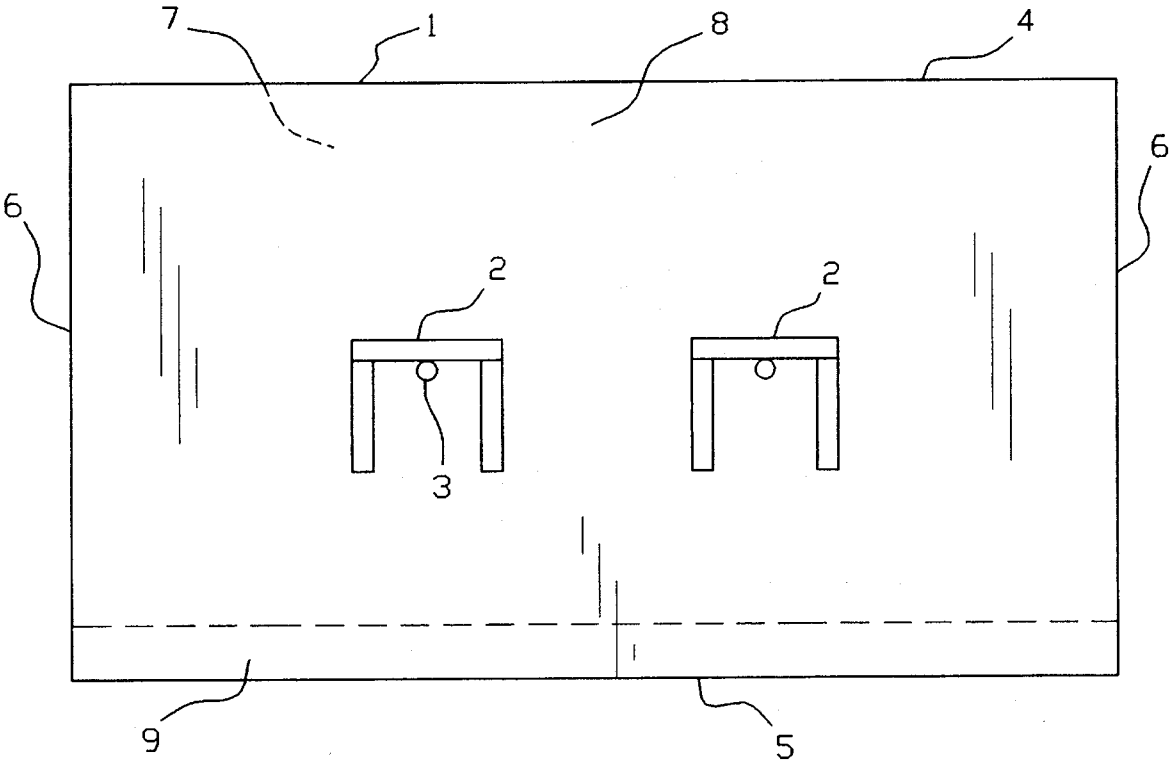
FIG. 1 shows a back view of the first blade.
Figure 4:
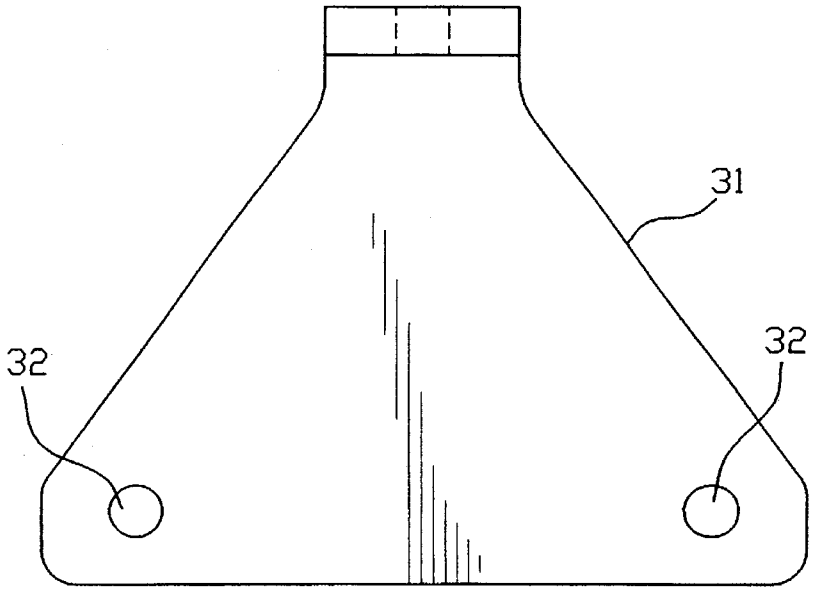
FIG. 4 shows a back view of the first attaching plate.

FIGS. 1 through 8 and their respective description detail an embodiment of the present invention which attaches to a grapple, wherein like parts are like numbered. Referring to FIG. 1, a first plate 1 is shown. First plate 1 comprises a front 7, a back 8, a leading edge 5, a rear edge 4, side edge 6 and apertures as typified by aperture 3 through which a fastener may be inserted. In this particular embodiment, first plate 1 is intended to mount on the stationary grapple jaw. Additionally, leading edge 5 is shown to be straight. A straight edge allows the device to contain fine debris when operated in conjunction with another straight edge (see FIG. 5). It should be noted, however, that leading edge 5 could have a set of tines which are designed to mesh with another set of tines. This too would provide the device with the means to handle small debris.

FIG. 1 also shows two chocks 2. Chocks 2 are sized to fit snugly between the tines of a grapple hook. Chocks 2 must fit snugly between the tines to transfer the force applied to first plate 1 to the jaws of the grapple. In this particular embodiment, chocks 2 are U-shaped structures which snugly contact the tines, but do so with minimal material, thus reducing weight and cost. It should be understood, however, that other embodiments are possible. For example, chocks 2 could be solid blocks or pegs which fit securely against the tines of the grapple. Moreover, the number of chocks can vary depending upon the number of tines.

Figure 2:
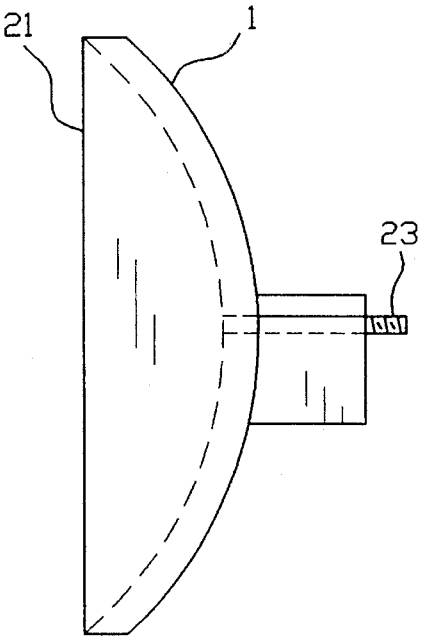
FIG. 2 shows a side view of the first blade and the first attaching means.

FIG. 2 shows a side of first plate 1. In this embodiment, first plate 1 is arcuately bent to conform to the bend of the grapple jaw. Side plates 21 are mounted substantially perpendicular to first plate 1. The combination of the arcuately bent first plate 1 and side plates 21 define a container for retaining debris. FIG. 2 also shows a fastener 23 which forms part of the first attachment means. In this embodiment, fastener 23 is contiguous to chocks 2. This arrangement aids in transferring any radial forces applied to fastener 23 through chocks 2 and onto the grapple jaws.

Figure 3:
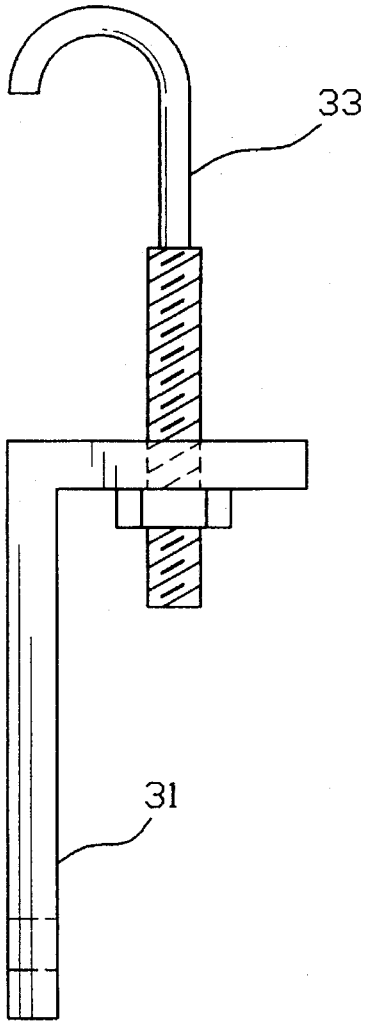
FIG. 3 shows a side view of the first attaching plate and hook.

FIG. 3 shows a first attaching plate 31 which forms another part of the first attaching means. First attaching plate 31 forms the backing for fastener 23. Fastener 23 passes through aperture 3 of first plate 1, between the tines of the grapple, and through aperture 32 of first attaching plate 31. In this way, fastener 23 serves to urge first plate 1 and first attaching plate 31 against the tines of the grapple, thereby holding the device fast.

FIG. 3 also shows a hook 33. Hook 33 is attached to first attaching plate 31 and hooks onto the grapple jaw. In this way, hook 33 aids in holding first attaching plate 31 secure. The combination of hook 33 and fastener 23 urging first plate 1 against the tines serves to hold first plate 1 secure even under high loads.

Figure 5:
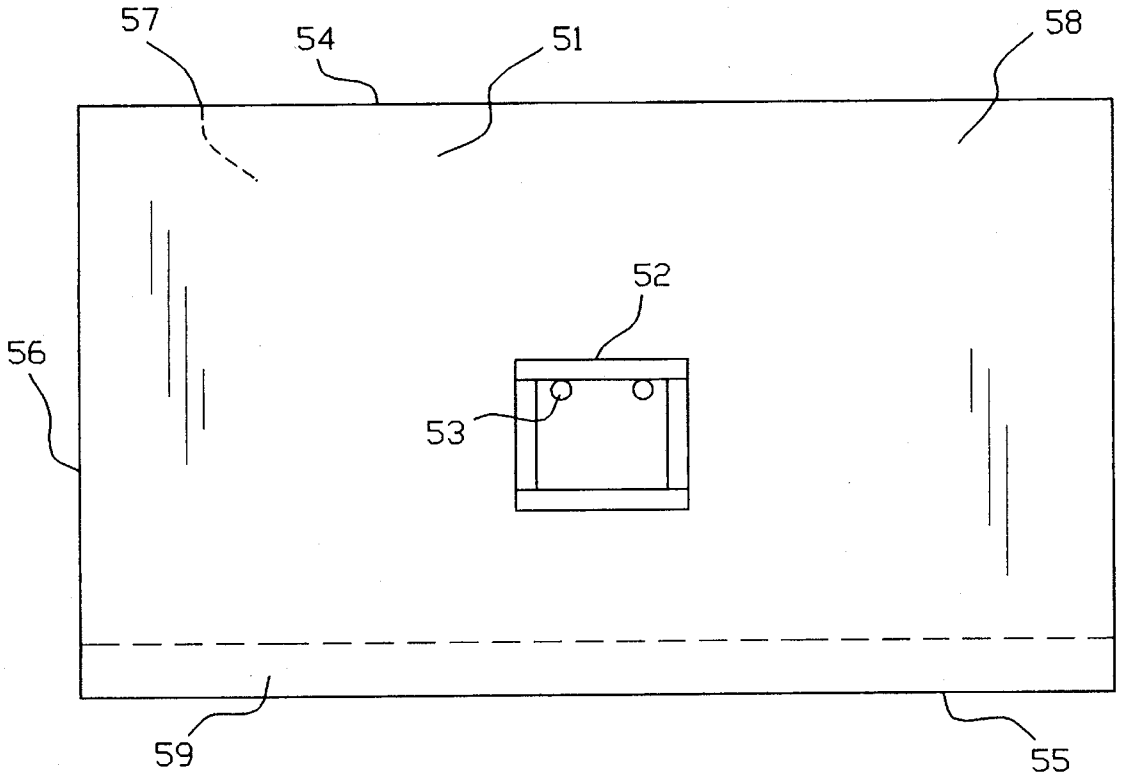
FIG. 5 shows a back view of the second blade.

FIGS. 5 through 8 depict features of a second plate 51 shown in FIG. 5. It should be noted that many of the features of second plate 51 are similar to first plate 1. Second plate 51 comprises a front 57, a back 58, a leading edge 55, a rear edge 54, and side edges 56. In this particular embodiment, second plate 51 is intended to mount on the movable grapple jaw.

FIG. 5 also shows a chock 52. Chock 52 with apertures typified by aperture 53 is sized to fit snugly between the tines of a grapple hook. Chock 52 should fit snugly between the tines to transfer the force applied to second plate 51 to the grapple jaw. In this particular embodiment, chock 52 is a rectangular structure of plates which intimately contacts the tines, but does so with minimal material, thus reducing weight and cost. It should be understood, however, that other embodiments are possible. For example, chock 52 could be solid blocks or pegs providing the shape of chock 52 securely fits against the tines of the grapple. Moreover, the number of chocks can vary depending upon the number of tines.

Figure 6:
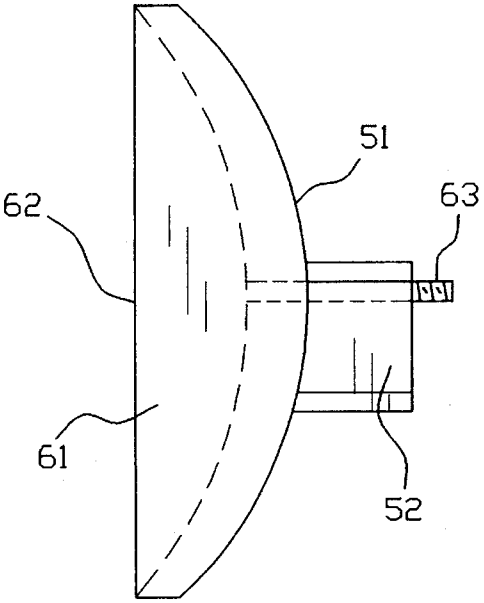
FIG. 6 shows a side view of the second blade and the second attaching means.

FIG. 6 shows a side of second plate 51. In this embodiment, second plate 51 is arcuately bent to conform to the bend of the grapple jaw. Side plates 61 are mounted substantially perpendicular to second plate 51. The combination of the arcuately bent second plate 51 and side plates 61 define a container for holding debris.

Figure 8:
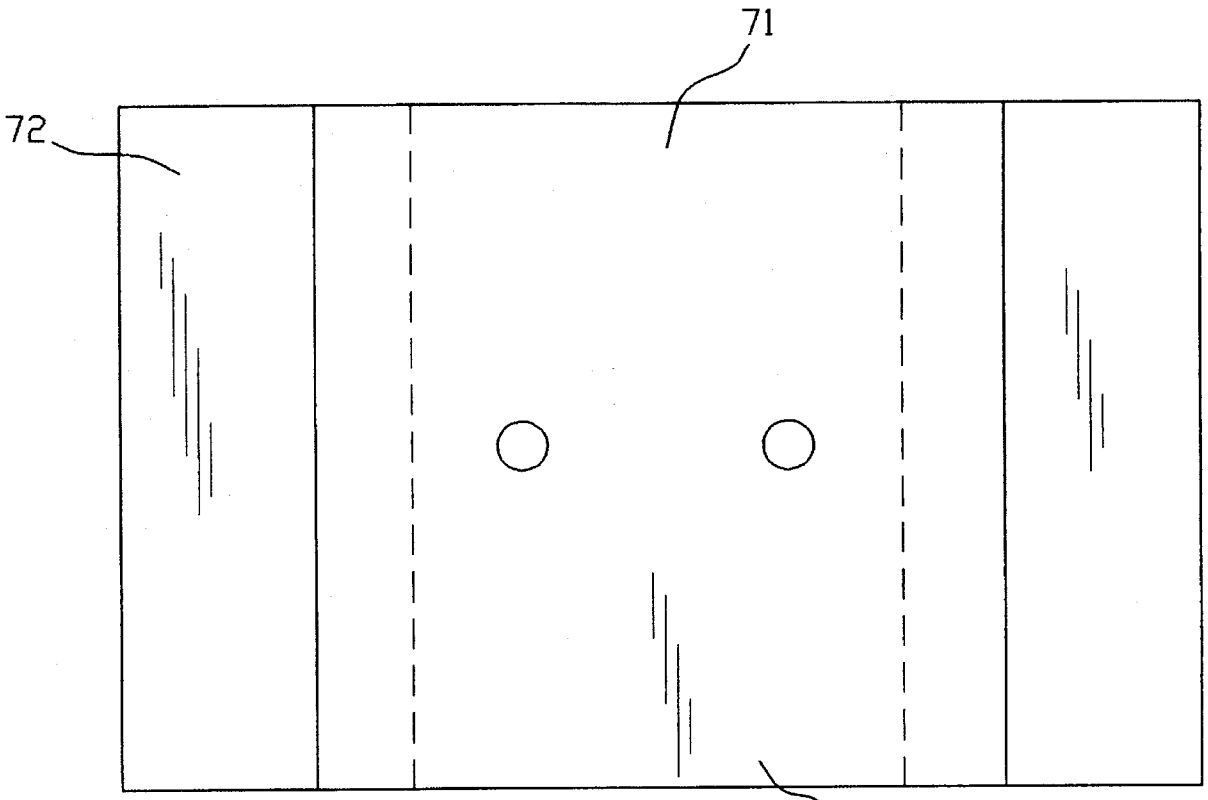
FIG. 8 shows a back view of the second attaching plate.
Figure 7:
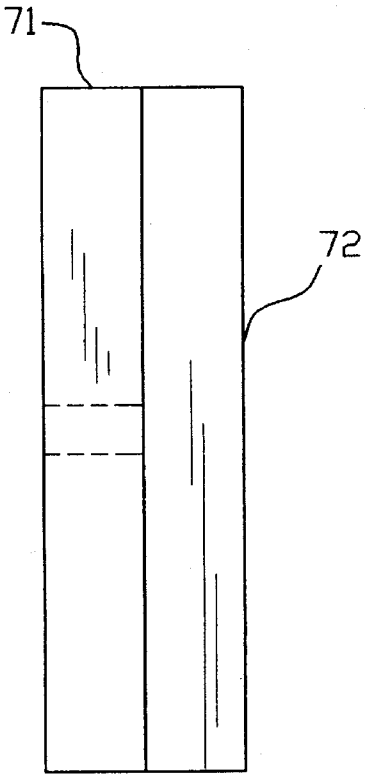
FIG. 7 shows a side view of the second attaching plate and hook.

FIG. 6 also shows typical fastener 63 which forms part of the second attachment means. Although two fasteners are depicted, it should be understood that one fastener may be adequate if properly sized. Another part of the second attaching means, a second attaching plate 71, is shown in FIGS. 7 and 8. Second attaching plate 71 forms the backing for fastener 63. Fastener 63 passes through second plate 51, between the tines of the grapple, and through second attaching plate 71. In this way, fastener 63 serves to urge second plate 51 and second attaching plate 71 against the tines of the grapple, thereby holding the device fast.

In this particular embodiment, second attaching plate 71 is sized to fit snugly against a raised portion of the tines which is common to many grapple jaws. Furthermore, second attaching plate 71 may comprise a central recess 84 as shown in FIG. 8. Central recess 84 is adapted to fit between the tines of the grapple jaw to prevent second attaching plate 71 from moving to and from said side edges. This interaction between second attaching plate 71 and the tines aids in further securing it. This interaction plus fastener 63 urging second plate 51 against the tines combine to hold second plate 51 secure even under high loads.

Figure 9:
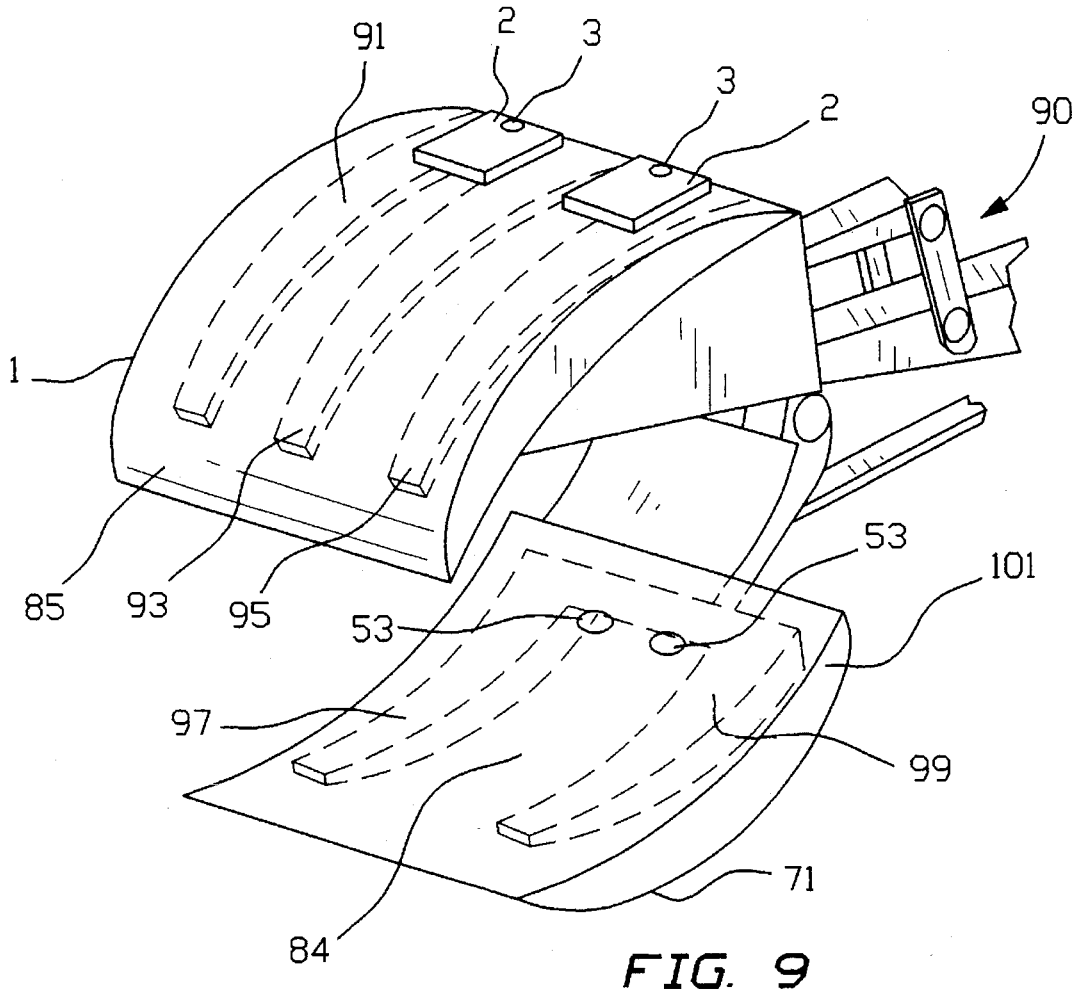
FIG. 9 shows a partial perspective view of the present invention device attached to a grapple hook.

FIG. 9 shows assembly 90 depicting one embodiment of the present invention attached to a tined grapple hook having stationery backstop tines 91, 93, 95, attached to first plate 1 and moving jaw tines 97, and 99 with a raised portion 101 which is accommodated by recess 84 in second plate 71.

Both the first and second attaching means may also comprise safety mechanisms such as securing chains. For example, chains may fasten the plates to the grapple jaw thereby preventing them from falling off in the unlikely event the attaching means fails. Such safety mechanism would serve to protect people and property in the immediate area. It should also be understood that attaching means may comprise welding the plates to the grapple jaws, thus insuring secured attachment.

In one preferred embodiment, first plate 1 is larger than second plate 51. This provides the moving jaw (second plate 51) with a wide stationary backstop (first plate 1). Although this design has proved very successful, it should be noted that other arrangements are possible. For example, second plate 51 could be wider thereby allowing first plate 1 to compact debris within second plate 51. The size of the plates may also depend upon other equipment such as the size of the truck receiving the debris.

In another preferred embodiment, leading edges 5 and 55 have replaceable edges 9 and 59 respectively (see FIGS. 1 and 5). Replaceable edges 9 and 59 can be replaced once they become worn or damaged. Replaceable edges 9 and 59 can be attached to leading edges 5 and 55 via fasteners or they can be welded.

Obviously, numerous modifications and variations of the present invention are possible in light of the above teachings. It is therefore understood that within the scope of the appended claims, the invention may be practiced otherwise than as specifically described herein.

What is claimed is:

1. A smooth edged attachment for a grapple, said attachment being adaptable to be added to a grapple having tined jaws to convert said grapple having tined jaws into a smooth edged device capable of holding fine debris, said attachment comprising:

a. a first and second plate each having a front, a back, a rear edge, a leading edge, and two side edges; and b. a first and second attaching means capable of securing said first and second plate to said grapple jaws, each attaching means comprising:

i. a chock mounted to said back of each plate, said chock adaptable to fit snugly between the tines of a tined grapple jaw;

ii. an attaching plate, said first and second attaching means corresponding to a first and second attaching plate respectively; and, iii. a fastener, said fastener capable of passing through each plate, between said tines, and through the respective attaching plate such that, when said fastener is tightened, each plate and its respective attaching plate urge against said tines thereby rigidly holding each plate.

2. The device of claim 1 wherein said chock on said first plate comprises a U-shaped structure substantially perpendicular to said back, said U-shaped structure sized to fit between the tines of said grapple and transfer the force applied to said first plate to said grapple jaw.

3. The device of claim 2 wherein said fastener passes through said first plate contiguous to said U-shaped structure such that forces on said fastener are transferred through said U-shaped structure to said grapple jaw.

4. The device of claim 1 wherein said first attaching means comprises a hook attached to said attaching plate, said hook configured to hook on said grapple jaw.

5. The device of claim 1 wherein said chock on said second plate comprises a rectangular structure substantially perpendicular to said back of said second plate, said rectangular structure sized to fit between the tines of said grapple jaw and transfer the force applied to said second plate to said grapple jaw.

6. The device of claim 1 wherein said second attaching plate rests upon a raised portion of said grapple jaw thereby stabilizing said second attaching plate and rigidly supporting said second plate; and wherein said second attaching plate comprises a central recess adapted to fit between the tines of said grapple jaw to prevent said second attaching plate from moving to and from said side edges.

7. A smooth edged attachment for a grapple, said attachment being adaptable to be added to a grapple having tined jaws to convert said tined grapple into a smooth edged grapple capable of holding fine debris, said attachment comprising:

a. a first and second plate each having a front, a back, a rear edge, a leading edge, and two side edges, each leading edge being smooth, said first and second plates being arcuately curved to conform to said grapple jaws, said first and second plates having side plates located on said edges of each plate, said side plates extending substantially perpendicular from said front of each plate thereby defining a container of each plate and its respective side plates, said side edges of said second plate being less distant than said side edges of said first side plate such that the second plate fits inside said first plate; and b. first and second attaching means for securing said first and second plate to said grapple jaws, each attaching means comprising:

i. a chock mounted to said back of each plate, said chock adaptable to fit snugly between the tines of a grapple jaw.

8. The device of claim 7 wherein each attaching means further comprises:

ii. an attaching plate, said first and second attaching means corresponding to a first and second attaching plate respectively; and, iii. a fastener, said fastener passing through each plate, between said tines, and through the respective attaching plate such that when said fastener is tightened each plate and its respective attaching plate urge against said tines thereby rigidly holding each plate.

9. The device of claim 8 wherein said chock on said first plate comprises a U-shaped structure substantially perpendicular to said back, said U-shaped structure sized to fit between the tines of said grapple and transfer the force applied to said first plate to said grapple jaw; and wherein said fastener passes through said first plate contiguous to said U-shaped structure such that forces on said fastener are transferred through said U-shaped structure to said grapple jaw.

10. The device of claim 8 wherein said first attaching means comprises a hook attached to said attaching plate, said hook designed to hook on said grapple jaw.

11. The device of claim 8 wherein said chock on said second plate comprises a rectangular structure substantially perpendicular to said back of said second plate, said rectangular structure sized to fit between the tines of said grapple jaw and transfer the force applied to said second plate to said grapple jaw; wherein second attaching plate rests upon a raised portion of said grapple jaw thereby stabilizing said second attaching plate and rigidly supporting said second plate; and wherein said second attaching plate comprises a central recess adapted to fit between the tines of said grapple jaw to prevent said second attaching plate from moving to and from said side edges.

* * * * *